US010322323B2

(12) United States Patent
Kii

(10) Patent No.: US 10,322,323 B2
(45) Date of Patent: Jun. 18, 2019

(54) GOLF CLUB HEAD

(71) Applicant: SUMITOMO RUBBER INDUSTRIES, LTD., Kobe-shi, Hyogo (JP)

(72) Inventor: Kenji Kii, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/965,221

(22) Filed: Apr. 27, 2018

(65) Prior Publication Data

US 2018/0333618 A1 Nov. 22, 2018

(30) Foreign Application Priority Data

May 18, 2017 (JP) ..... 2017-098689

(51) Int. Cl.
*A63B 53/04* (2015.01)
*A63B 60/52* (2015.01)
*A63B 102/32* (2015.01)

(52) U.S. Cl.
CPC ..... *A63B 53/047* (2013.01); *A63B 60/52* (2015.10); *A63B 2053/0408* (2013.01); *A63B 2053/0416* (2013.01); *A63B 2053/0433* (2013.01); *A63B 2053/0445* (2013.01); *A63B 2102/32* (2015.10)

(58) Field of Classification Search
USPC ..... 473/324–350
See application file for complete search history.

(56) References Cited

U.S. PATENT DOCUMENTS 6,506,129 B2 1/2003 Chen
6,746,342 B1 * 6/2004 Hsieh ..... A63B 53/047 473/342
6,841,014 B2 * 1/2005 Huang ..... A63B 53/0475 148/608
7,121,958 B2 * 10/2006 Cheng ..... A63B 53/047 473/345
7,371,188 B2 * 5/2008 Chen ..... A63B 53/04 473/329

(Continued)

FOREIGN PATENT DOCUMENTS

GB 2192795 A * 1/1988 ..... A63B 53/04
JP 07163686 A * 6/1995 ..... A63B 53/04

(Continued)

*Primary Examiner* — Alvin A Hunter
(74) *Attorney, Agent, or Firm* — Birch, Stewart, Kolasch & Birch LLP

(57) ABSTRACT

A head 2 includes: a face member fc1 having a hitting surface 4; and a body member bd1 having a hosel 6, a sole surface 8, and a toe-side surface 9. The face member fc1 further has a top-side flange FL1 including a top surface 5. The body member bd1 has a hosel-forming part 24 including the hosel 6, a sole-forming part 28 including the sole surface 8, and a toe-forming part 26 including the toe-side surface 9. The hosel-forming part 24 has a heel joint portion Jh joined to a heel-side end of the top-side flange FL1. The toe-forming part 26 has a toe joint portion Jt joined to a toe-side end of the top-side flange FL1. A body missing portion ms1 in which the body member bd1 is not present is provided between the toe joint portion Jt and the heel joint portion Jh.

12 Claims, 20 Drawing Sheets

(56) References Cited

U.S. PATENT DOCUMENTS

| | | | | |
|---|---|---|---|---|
| 7,604,550 | B1 * | 10/2009 | Currie | A63B 53/047 473/342 |
| 7,662,051 | B2 * | 2/2010 | Chen | A63B 53/047 473/342 |
| 7,892,109 | B2 * | 2/2011 | Rice | A63B 60/00 473/329 |
| 8,216,088 | B2 * | 7/2012 | Hatton | A63B 53/047 473/335 |
| 9,731,170 | B2 * | 8/2017 | Franklin | A63B 53/02 |
| 2004/0266548 | A1 * | 12/2004 | Cheng | A63B 53/047 473/342 |
| 2006/0030424 | A1 * | 2/2006 | Su | A63B 53/0466 473/342 |
| 2006/0293119 | A1 * | 12/2006 | Hou | A63B 53/047 473/342 |

FOREIGN PATENT DOCUMENTS

| | | | | | |
|---|---|---|---|---|---|
| JP | 09154987 | A | * | 6/1997 | |
| JP | 09285577 | A | * | 11/1997 | |
| JP | 10057534 | A | * | 3/1998 | |
| JP | 2004215724 | A | * | 8/2004 | |
| JP | 2008154624 | A | * | 7/2008 | A63B 53/0466 |
| JP | 2010110529 | A | * | 5/2010 | |
| JP | 4958625 | B2 | | 6/2012 | |
| JP | 5416737 | B2 | | 2/2014 | |
| WO | WO 2005035074 | A1 | * | 4/2005 | A63B 53/047 |

* cited by examiner

GOLF CLUB HEAD

The present application claims priority on Patent Application No. 2017-98689 filed in JAPAN on May 18, 2017, the entire contents of which are hereby incorporated by reference.

BACKGROUND OF THE INVENTION

Field of the Invention

The present invention relates to a golf club head.

Description of the Related Art

As to a golf club head including a body member and a face member attached to the body member, the following patens are disclosed. Each of Japanese Patent No. 5416737 and Japanese Patent No. 4958625 discloses a head including a face member having a bent portion which is bent backward at a sole-side end of the face member. U.S. Pat. No. 7,371,188 discloses a hitting plate part having an annular wall. U.S. Pat. No. 6,506,129 discloses a front member having an extension portion.

SUMMARY OF THE INVENTION

The inventor of the present application has found that there is room to improve a head including a body member and a face member attached to the body member.

The present disclosure provides a golf club head excellent in rebound performance.

In one aspect, a golf club head includes a top surface, a hitting surface, a sole surface, a toe-side surface, and a hosel. The golf club head may include a face member having the hitting surface, and a body member having the hosel, the sole surface and the toe-side surface. The face member may further have a top-side flange including the top surface. The body member may have a hosel-forming part including the hosel, a sole-forming part including the sole surface, and a toe-forming part including the toe-side surface. The hosel-forming part may have a heel joint portion joined to a heel-side end of the top-side flange. The toe-forming part may have a toe joint portion joined to a toe-side end of the top-side flange. A body missing portion in which the body member is not present may be provided between the toe joint portion and the heel joint portion.

In another aspect, the body missing portion may be disposed at the same toe-heel direction position as that of a face center.

In another aspect, the body missing portion may be disposed at a toe side with respect to the face center.

In another aspect, the body missing portion may be disposed at a heel side with respect to the face center.

In another aspect, the face member may further have a sole-side flange including the sole surface.

BRIEF DESCRIPTION OF THE DRAWINGS

FIG. 13 is a drawing viewed from an obliquely front side;

FIG. 14 is a drawing viewed from an obliquely rear side;

DESCRIPTION OF THE PREFERRED EMBODIMENTS

Hereinafter, preferred embodiments will be described in detail with appropriate references to the accompanying drawings.

In the present application, the following terms are defined.

[Base State]

The base state is a state where a head is placed at a specified lie angle and real loft angle on a level surface HP. In the base state, a center axis line Z (shaft axis line Z) of a shaft hole of the head is disposed in a perpendicular plane VP (see FIG. 20). The perpendicular plane VP is a plane perpendicular to the level surface HP. In the base state, a face surface (hitting surface) is inclined at a real loft angle with respect to the perpendicular plane VP. The specified lie angle and real loft angle are described in, for example, a product catalog.

[Toe-Heel Direction]

Figure 20:
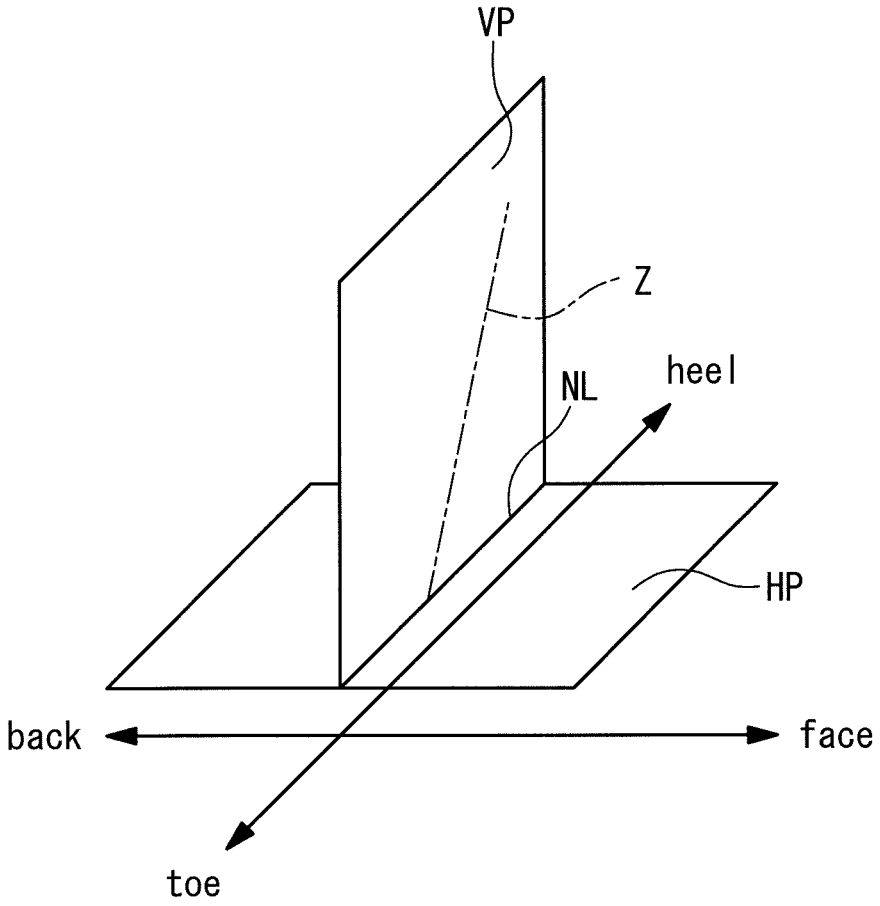
FIG. 20 is a view for illustrating a base state.

In the head of the base state, a direction of an intersection line NL between the perpendicular plane VP and the level surface HP is the toe-heel direction (see FIG. 20). A toe side and a heel side used in the present application should be based on the toe-heel direction.

[Face-Back Direction]

A direction perpendicular to the toe-heel direction and parallel to the level surface HP is the face-back direction (see FIG. 20). A face side and a back side used in the present application should be based on the face-back direction.

[Up-Down Direction]

A direction perpendicular to the toe-heel direction and parallel to the hitting surface is the up-down direction. An upper side and a lower side used in the present application should be based on the up-down direction.

[Front-Rear Direction]

A direction perpendicular to the hitting surface (face) is defined as the front-rear direction. In other words, a direction of a normal line of the hitting surface is defined as the front-rear direction. A front side and a rear side used in the present application should be based on the front-rear direction.

[Face Center Fc]

Figure 2:
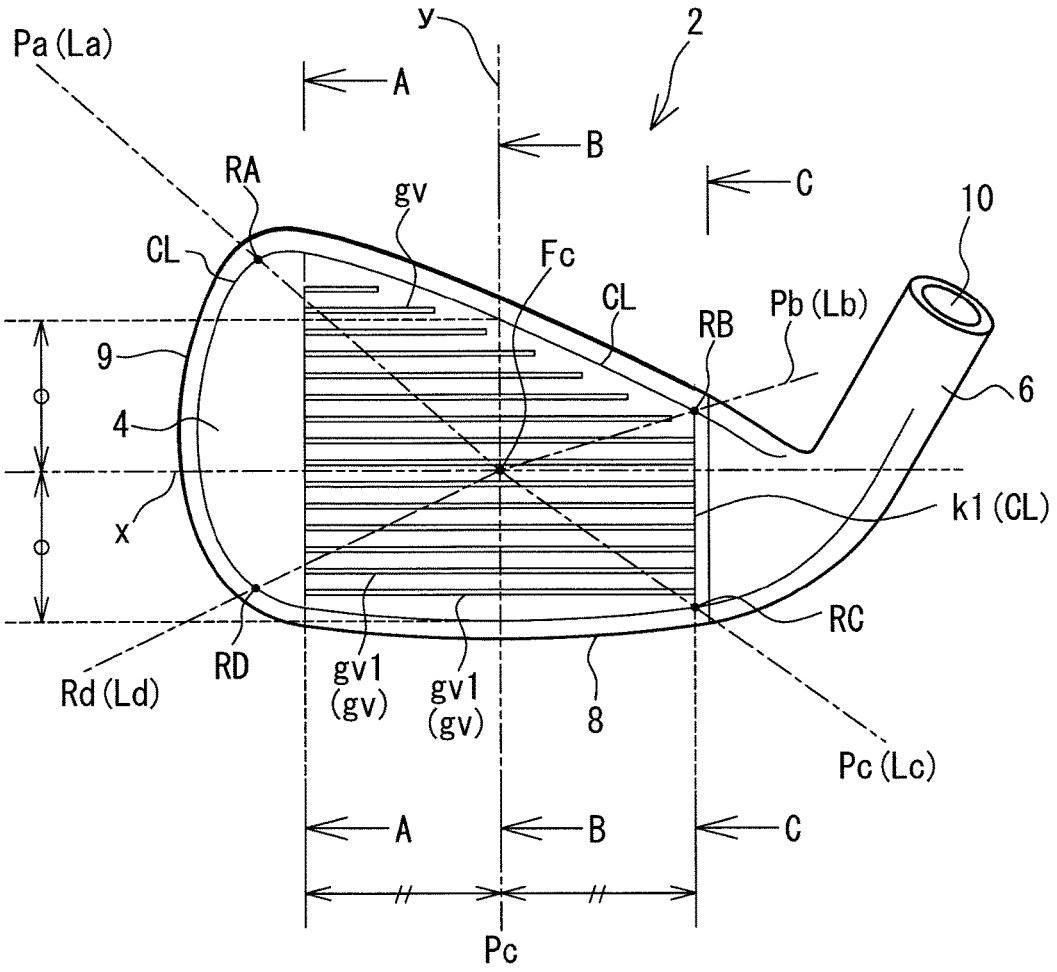
FIG. 2 is a front view of the head in FIG. 1.

A middle position of a longest score line gv1 in the toe-heel direction is a middle position Pc of score lines in the toe-heel direction (see FIG. 2). On the middle position Pc, a center point of the face surface in the up-down direction is determined. The center point in the up-down direction is the face center Fc (see FIG. 2).

[Top-Side Region, Sole-Side Region, Toe-Side Region, Heel-Side Region]

In the present application, terms of the top-side region, the sole-side region, the toe-side region, and the heel-side region are used.

In a front view of FIG. 2 (to be described later), a straight line x and a straight line y are defined. The straight line x is a straight line passing through the face center Fc and parallel to the toe-heel direction. The straight line y is a straight line passing through the face center Fc and parallel to the up-down direction.

Figure 11:
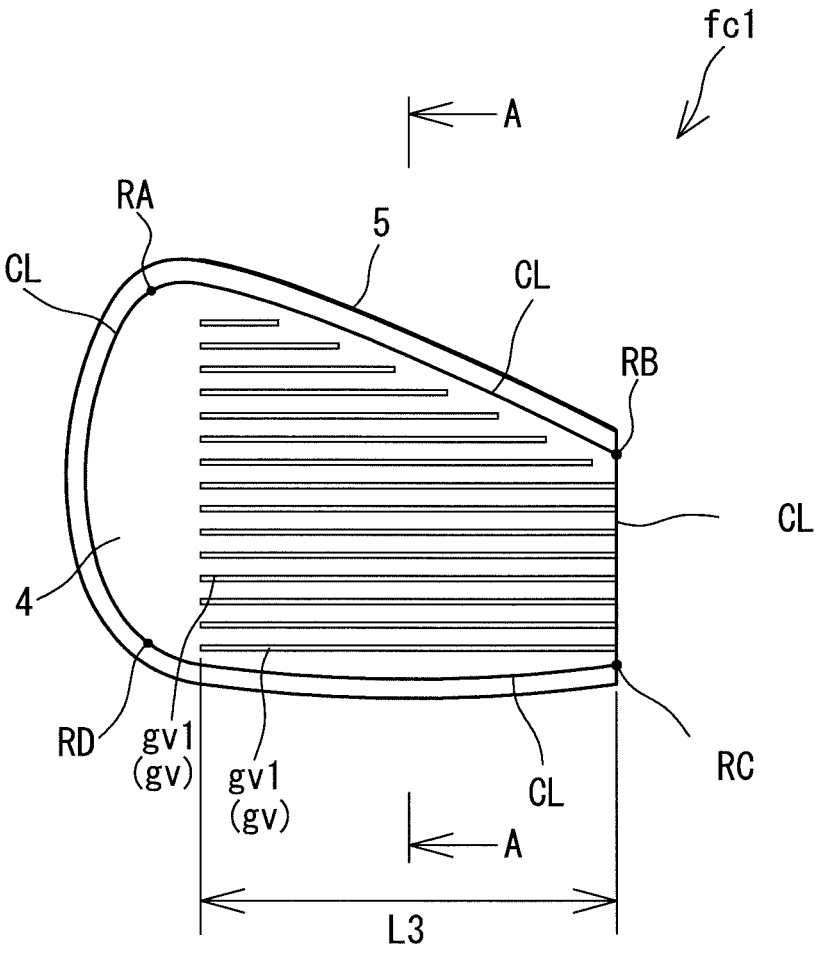
FIG. 11 is a front view of a face member used for the head in FIG. 1.

As shown in FIG. 2, a contour line CL of the hitting surface 4 is divided into four sections by the straight line x and the straight line y. A curvature-radius minimum point is determined in each of the four sections. In FIG. 2 and FIG. 11 to be described later, the curvature-radius minimum point in a toe-upper section is shown by symbol RA. The curvature-radius minimum point in a heel-upper section is shown by symbol RB. The curvature-radius minimum point in a heel-lower section is shown by symbol RC. The curvature-radius minimum point in a toe-lower section is shown by symbol RD. Note that, in each of the sections, when there is a pointed vertex, this point is considered as the curvature-radius minimum point. In the present embodiment, the point RB and the point RC are vertexes of angles, and thus these points RB and RC are considered as the curvature-radius minimum points.

As shown in FIG. 2, a straight line which connects the point RA and the face center Fc is a straight line La. A straight line which connects the point RB and the face center Fc is a straight line Lb. A straight line which connects the point RC and the face center Fc is a straight line Lc. A straight line which connects the point RD and the face center Fc is a straight line Ld.

A face member fc1 can be divided into four sections by expanding the straight lines La to Ld into three dimensions. A plane Pa which includes the straight line La and is perpendicular to the hitting surface 4; a plane Pb which includes the straight line Lb and is perpendicular to the hitting surface 4; a plane Pc which includes the straight line Lc and is perpendicular to the hitting surface 4; and a plane Pd which includes the straight line Ld and is perpendicular to the hitting surface 4 are defined (see FIG. 2). The face member fc1 is divided into the toe-side region, the heel-side region, the top-side region, and the sole-side region by the four planes Pa, Pb, Pc, and Pd.

Figure 1:
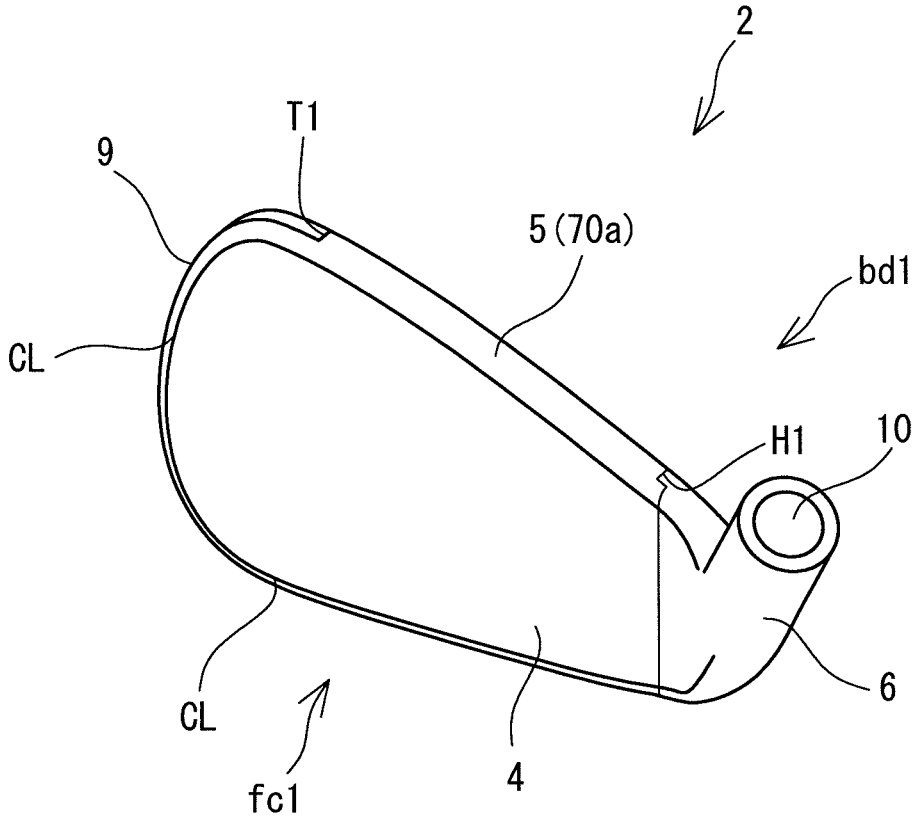
FIG. 1 is a perspective view of a golf club head according to a first embodiment.
Figure 3:
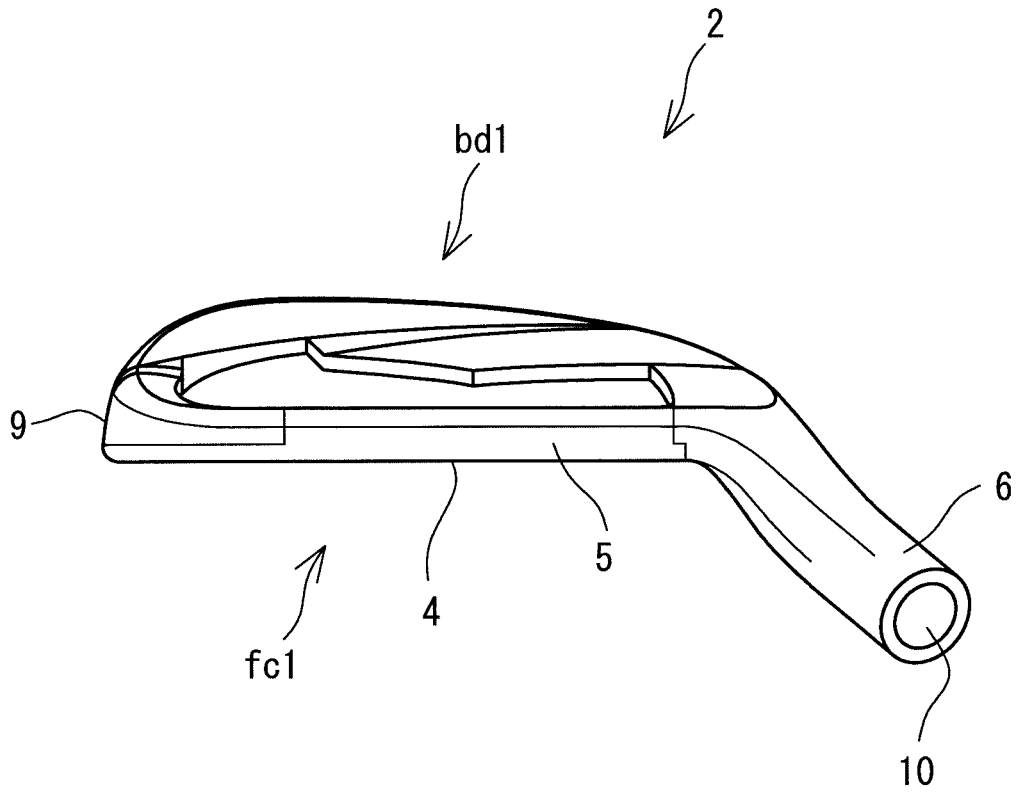
FIG. 3 is a plan view of the head in FIG. 1 as viewed from a top side.
Figure 4:
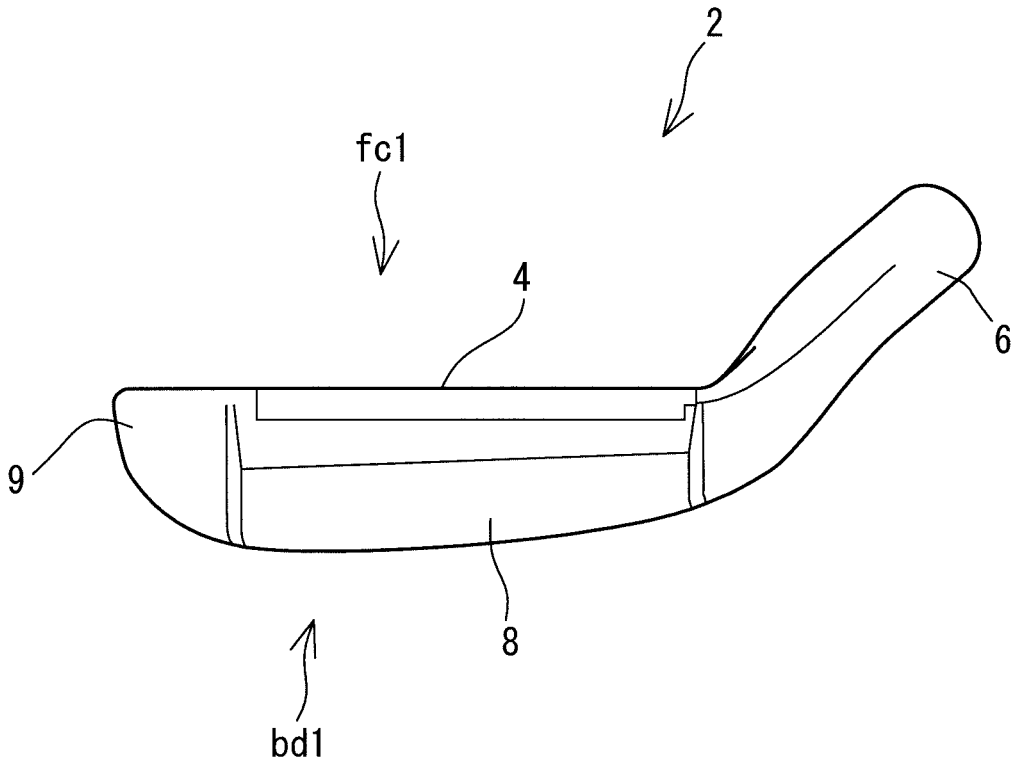
FIG. 4 is a bottom view of the head in FIG. 1 as viewed from a sole side.
Figure 5:
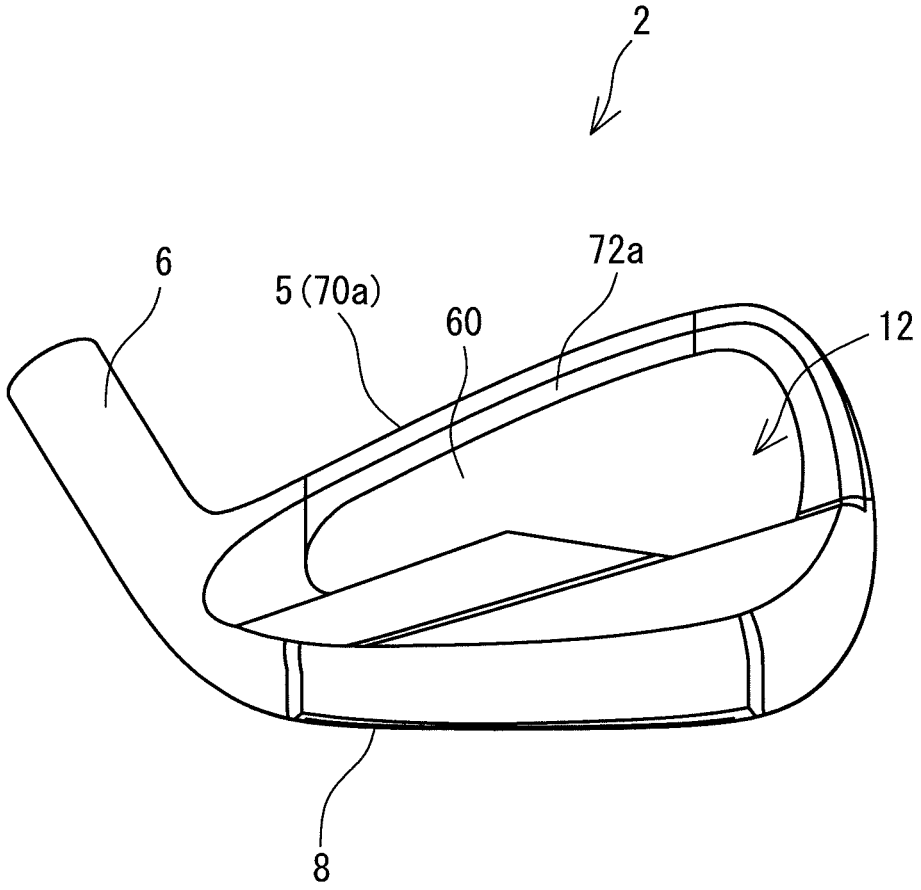
FIG. 5 is a back view of the head in FIG. 1.

FIG. 1 is a perspective view of a golf club head 2 according to a first embodiment. FIG. 2 is a front view of the head 2. FIG. 2 is a diagram viewed from the front of the hitting surface. FIG. 3 is a plan view of the head 2 as viewed from a top side. FIG. 4 is a bottom view of the head 2 as viewed from a sole side. FIG. 5 is a back view of the head 2.

The head 2 includes a hitting surface 4, a top surface 5, a hosel 6, a sole surface 8 and a toe-side surface 9. The toe-side surface 9 constitutes a surface on the toe side of the head 2. The hosel 6 has a hosel hole 10. The hitting surface 4 is also referred to as a face surface. As shown in FIG. 2, a plurality of score lines gv are provided on the front surface of the hitting surface 4. The score lines gv include the longest score line gv1. The longest score line gv1 is the longest score line in the score lines gv. Note that the score lines are not depicted in the drawings other than FIG. 2. The head 2 is an iron type golf club head.

If the score lines gv are disregarded, the hitting surface 4 is a plane. The hitting surface 4 has the contour line CL. The contour line CL is a boundary between the plane and a non-flat surface.

As shown in FIG. 5, in the head 2, a back cavity (recess part) 12 is provided on the opposite side of the hitting surface 4. The head 2 is a cavity back iron.

Figure 6:
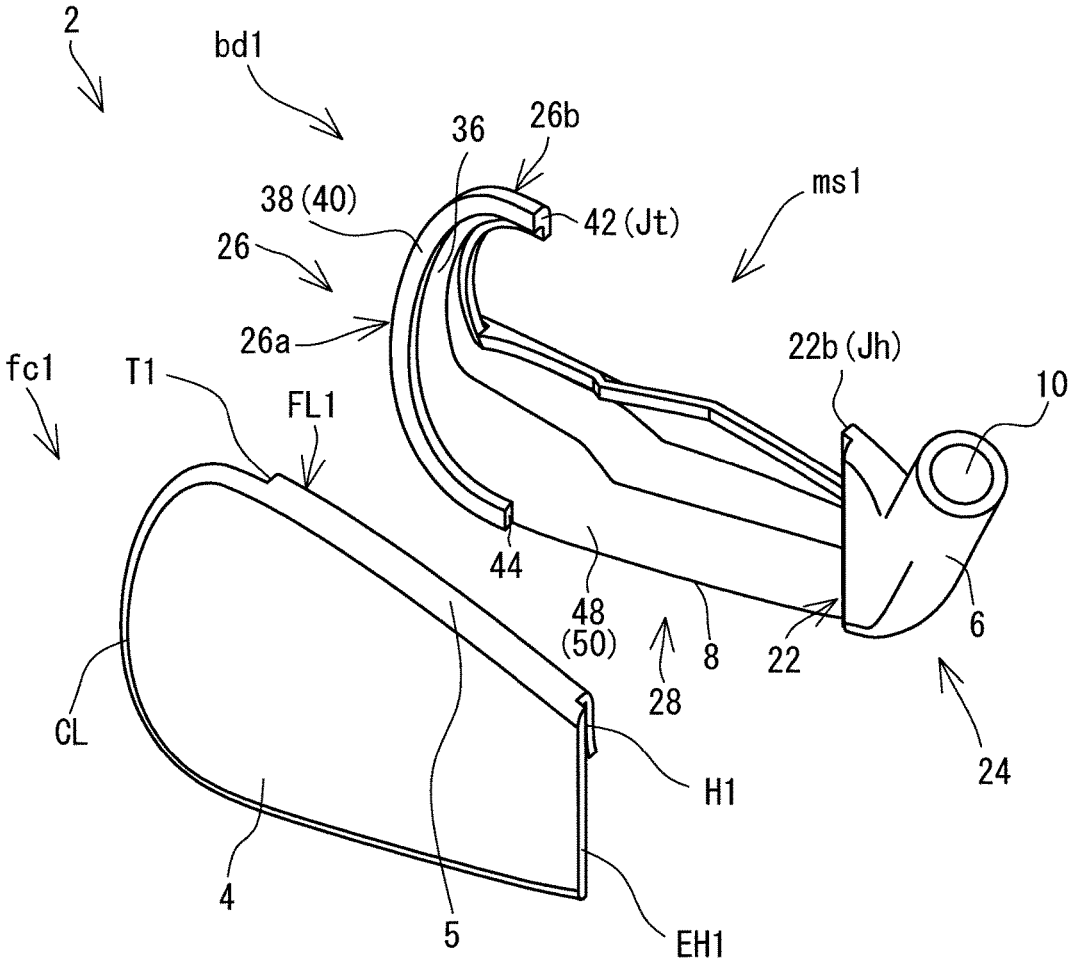
FIG. 6 is an exploded perspective view of the head in FIG. 1.
Figure 7:
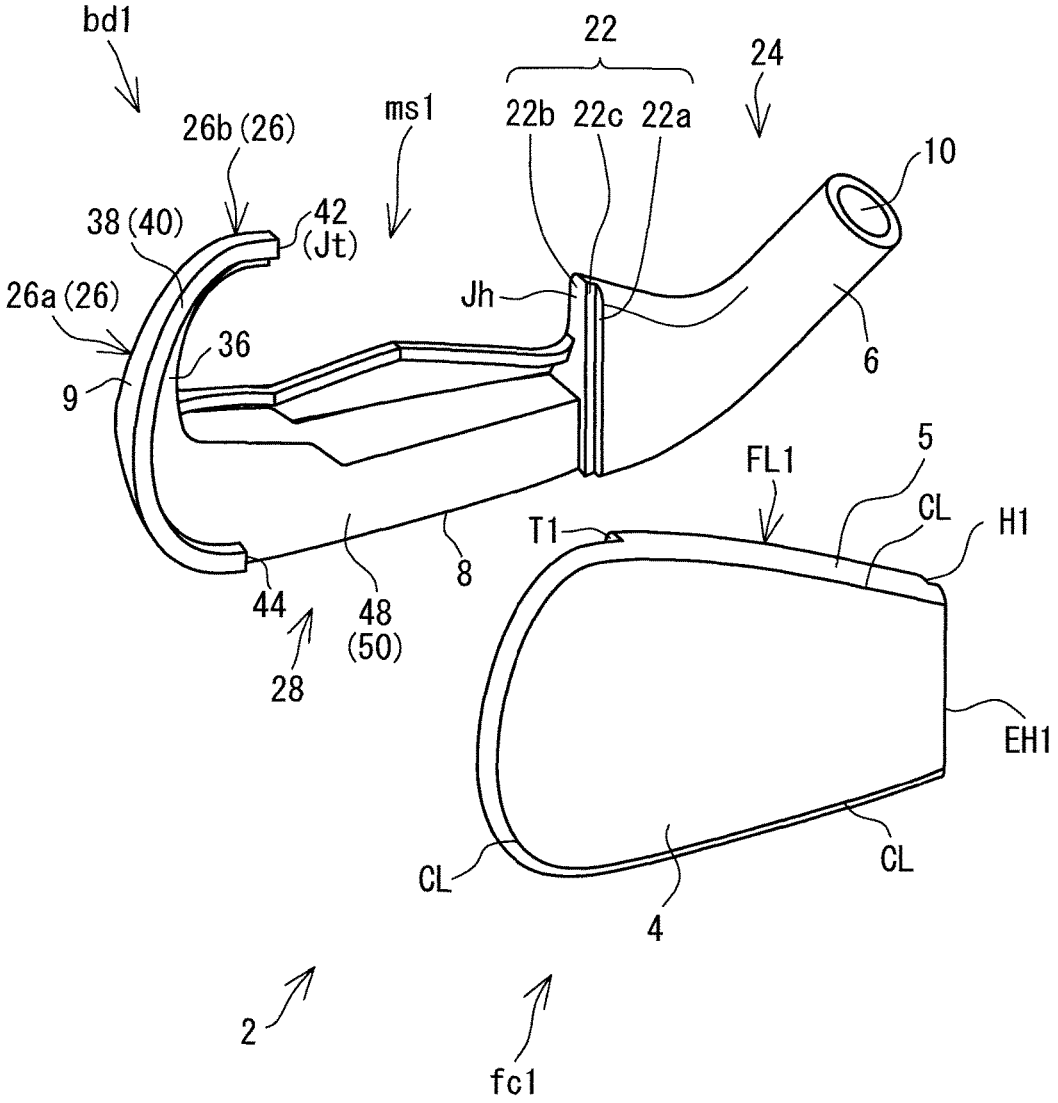
FIG. 7 is an exploded perspective view of the head in FIG. 1 as viewed from a point different from the viewpoint of FIG. 6.
Figure 8:
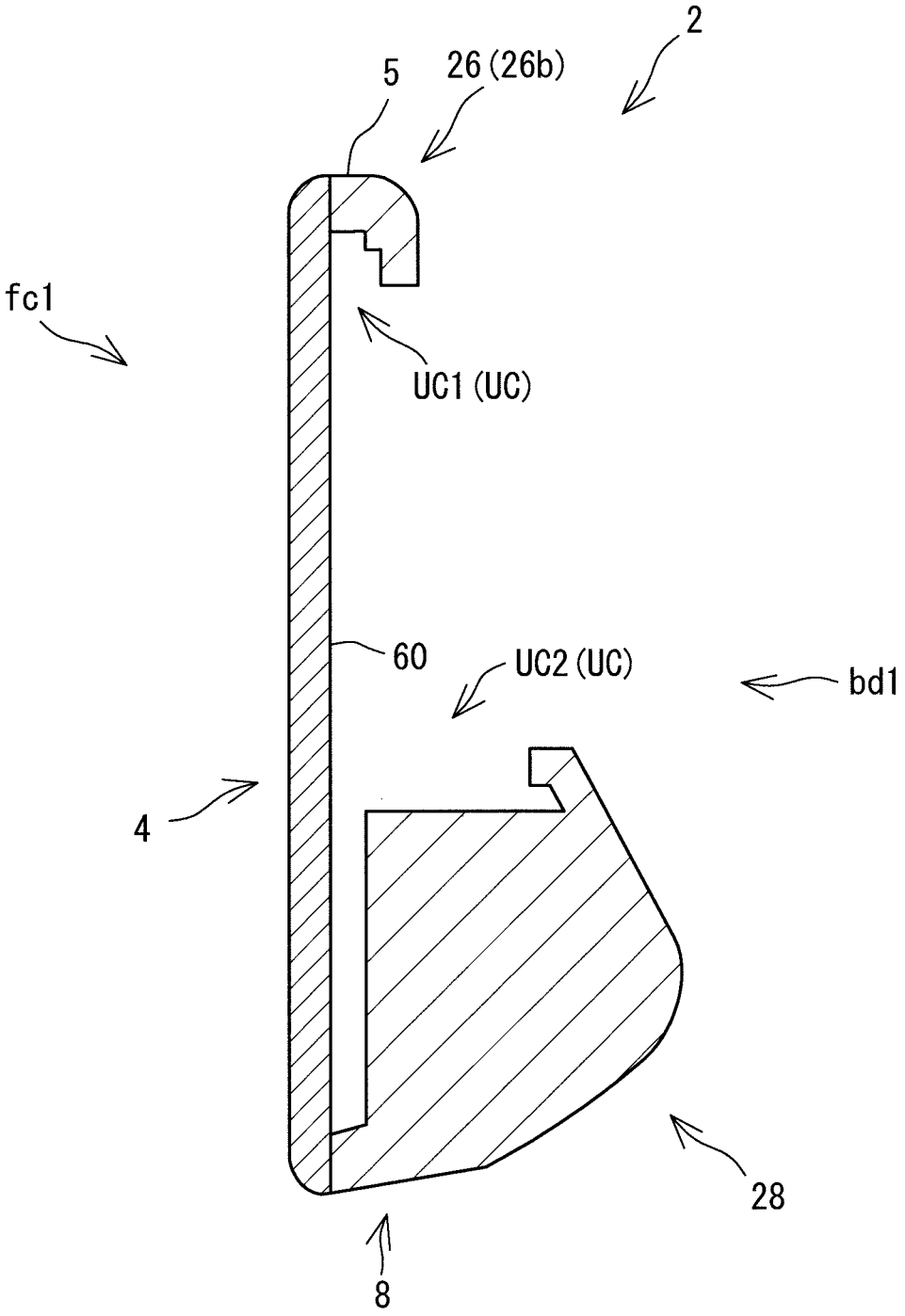
FIG. 8 is a sectional view taken along line A-A in FIG. 2.
Figure 9:
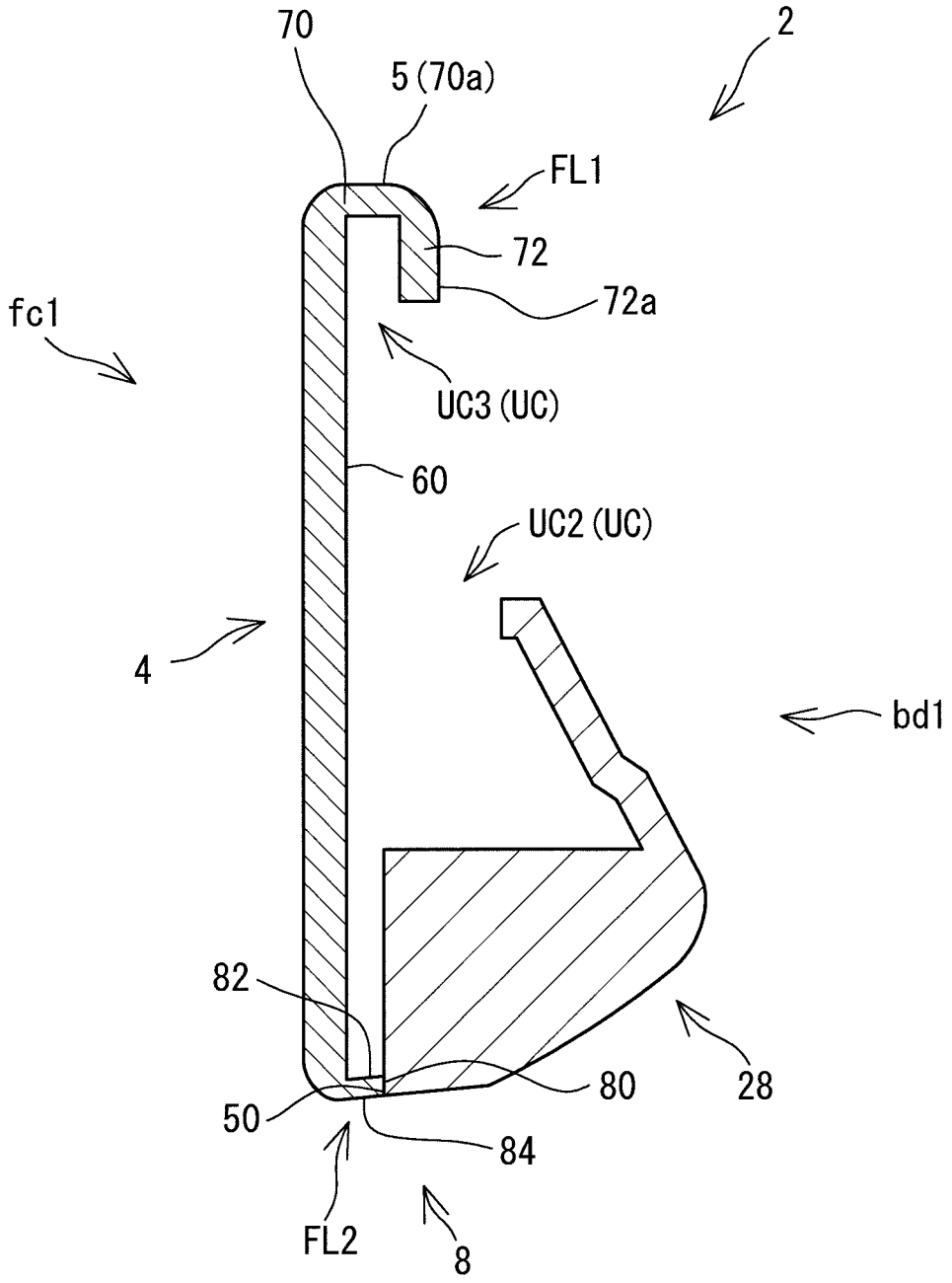
FIG. 9 is a sectional view taken along line B-B in FIG. 2.
Figure 10:
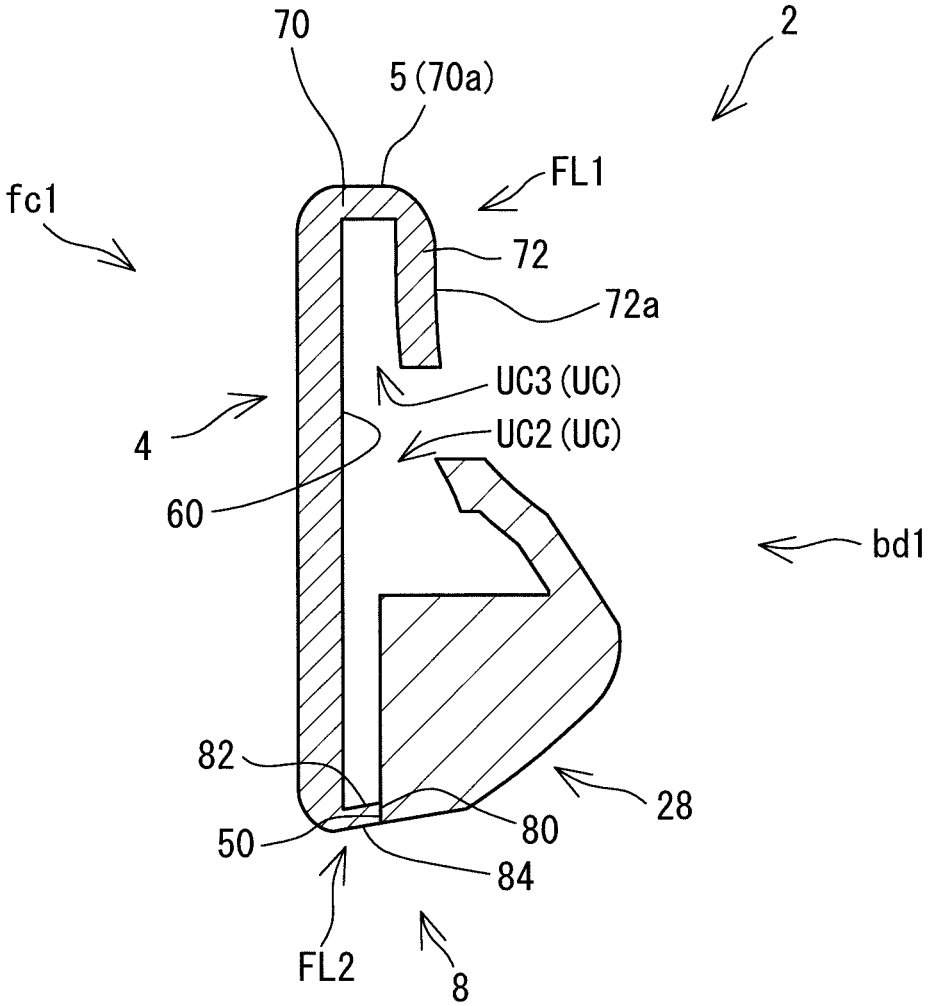
FIG. 10 is a sectional view taken along line C-C in FIG. 2.

FIG. 6 is an exploded perspective view of the head 2. FIG. 7 is an exploded perspective view of the head 2 as viewed from a different angle. FIG. 8 is a sectional view taken along line A-A in FIG. 2. FIG. 9 is a sectional view taken along line B-B in FIG. 2. FIG. 10 is a sectional view taken along line C-C in FIG. 2.

The head 2 includes a body member bd1 and a face member fc1. The face member fc1 is fixed to the body member bd1. The face member fc1 is welded to the body member bd1. The body member bd1 is made of a metal. In the present embodiment, the body member bd1 is made of stainless steel. The face member fc1 is made of a metal. In the present embodiment, the face member fc1 is made of stainless steel. The materials of the body member bd1 and the face member fc1 are not limited.

The face member fc1 is integrally formed as a whole. The face member fc1 may be constituted with a plurality of members. The face member fc1 may be formed by joining a plurality of members to each other. The body member bd1 is integrally formed as a whole. The body member bd1 may be constituted with a plurality of members. The body member bd1 may be formed by joining a plurality of members to each other.

The specific gravity of the face member fc1 may be smaller than the specific gravity of the body member bd1. The face member fc1 having a smaller specific gravity contributes to the distribution of the weight of the head 2 to the circumference. In light of welding strength, the material of the face member fc1 is preferably the same as that of the body member bd1.

The body member bd1 includes the hosel 6. The body member bd1 includes the whole hosel 6. The body member bd1 includes the sole surface 8. The body member bd1 includes a part (large part) of the sole surface 8. The body member bd1 does not include the hitting surface 4. The body member bd1 may include a part of the hitting surface 4.

The body member bd1 has a heel boundary surface 22, a hosel-forming part 24, a toe-forming part 26, and a sole-forming part 28 (see FIG. 6 and FIG. 7).

The heel boundary surface 22 is extended in the up-down direction. The heel boundary surface 22 may not be extended in the up-down direction. The heel boundary surface 22 is located on a boundary between the face member fc1 and the body member bd1.

The heel boundary surface 22 includes a first heel boundary surface 22*a*, a second heel boundary surface 22*b*, and a third heel boundary surface 22*c*. The first heel boundary surface 22*a* is extended in the up-down direction. The second heel boundary surface 22*b* is extended in the up-down direction. The third heel boundary surface 22*c* is extended in the up-down direction.

The first heel boundary surface 22*a* is a plane. The first heel boundary surface 22*a* is the plane parallel to the face-back direction. The second heel boundary surface 22*b* is a plane. The second heel boundary surface 22*b* is the plane parallel to the face-back direction. The second heel boundary surface 22*b* is located at the rear side with respect to the first heel boundary surface 22*a*. The third heel boundary surface 22*c* is a stepped surface which connects the first heel boundary surface 22*a* and the second heel boundary surface 22*b*. The third heel boundary surface 22*c* is a plane parallel to the toe-heel direction. The third heel boundary surface 22*c* is parallel to the hitting surface 4.

The hosel-forming part 24 includes the hosel 6. The hosel-forming part 24 includes the whole hosel 6. The hosel-forming part 24 may include only a part of the hosel 6. In the body member bd1, a portion located on the heel side with respect to the heel boundary surface 22 is the hosel-forming part 24. The hosel-forming part 24 does not include the hitting surface 4.

The sole-forming part 28 is extended toward the toe side from the hosel-forming part 24. The sole-forming part 28 includes the sole surface 8. The sole-forming part 28 includes a part (large part) of the sole surface 8. The sole-forming part 28 may include the whole sole surface 8.

The toe-forming part 26 has an upward extending part 26*a* which is upwardly extended from a toe-side end of the sole-forming part 28, and a heel-side extending part 26*b* which is extended toward the heel side from an upper end portion of the upward extending part 26*a*. The upward extending part 26*a* and the heel-side extending part 26*b* form the toe-forming part 26 which is curvedly extended so as to project toward the toe side. At least a part of the heel-side extending part 26*b* is located in the top-side region. The heel-side extending part 26*b* may not be present.

The toe-forming part 26 includes the toe-side surface 9. The toe-forming part 26 includes the whole toe-side surface 9. The toe-forming part 26 may include only a part of the toe-side surface 9. The toe-side surface 9 is a side surface of the upward extending part 26*a*.

The toe-forming part 26 has a toe base part 36 and a toe wall part 38 projected forward from the toe base part 36. The toe wall part 38 is provided along an outer edge of the toe base part 36. The toe wall part 38 has a toe receiving surface 40. The toe receiving surface 40 constitutes a front surface of the toe wall part 38. The toe receiving surface 40 is a plane. The toe receiving surface 40 is the plane parallel to the hitting surface 4.

Figure 14:
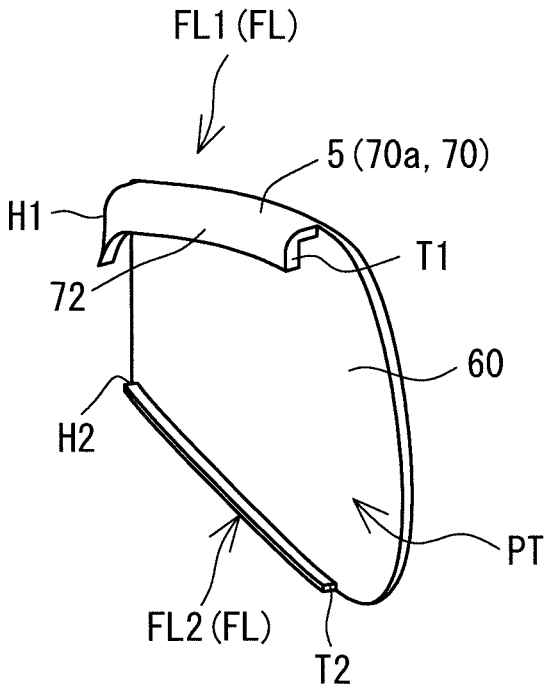
FIG. 14 is a perspective view of the face member in FIG. 11.

The toe receiving surface 40 that is the front surface of the toe wall part 38 is brought into contact with a back surface 60 of the face member fc1. As shown in FIG. 14 to be described later, although a flange FL is not provided in the toe-side region of the face member fc1, the toe receiving surface 40 supports a peripheral edge part in the toe-side region of the face member fc1. The toe wall part 38 projected forward enables a flat plate portion PT to be floating from the body member bd1 even in the toe-side region in which the flange FL is not present. For this reason, the flat plate portion PT is apt to be deformed at impact also in the toe-side region. The toe wall part 38 contributes to improvement in rebound performance.

The toe wall part 38 as a whole is curved so as to project toward the outside of the head 2. The toe wall part 38 is located at least in the toe-side region. The toe wall part 38 is present also in the top-side region. Of the toe wall part 38, a portion belonging to the heel-side extending part 26*b* is located in the top-side region. The toe wall part 38 is present also in the sole-side region. The toe wall part 38 is extended from the top-side region, through the toe-side region, to the sole-side region.

As well shown in FIG. 6, the toe-forming part 26 has an end face 42. The end face 42 is an end face of the heel-side extending part 26*b*. The end face 42 is located in the top-side region. The end face 42 includes an end face on the top side (one side) of the toe wall part 38.

As well shown in FIG. 6, the toe wall part 38 has a sole-side end face 44. The sole-side end face 44 is an end face on the other side of the toe wall part 38. The sole-side end face 44 is located in the sole-side region. The toe wall part 38 is curvedly extended from the top-side end face 42 to the sole-side end face 44.

The sole-forming part 28 has the sole surface 8 and a front surface 48. The front surface 48 is a plane. The front surface 48 is the plane parallel to the hitting surface 4. The front surface 48 shares a common plane with the toe base part 36. The sole-forming part 28 has a sole receiving surface 50. The sole receiving surface 50 is a plane. The sole receiving surface 50 is the plane parallel to the hitting surface 4. The sole receiving surface 50 shares a common plane with the front surface 48.

Of the body member bd1, a portion between the end face 42 of the toe-forming part 26 and an upper end portion of the heel boundary surface 22 is missing. In the body member bd1, a body missing portion ms1 is provided between the end face 42 of the toe-forming part 26 and the heel boundary surface 22. The body missing portion ms1 is provided between the toe joint portion Jt and the heel joint portion Jh. When the body member bd1 is seen as a single member, the body missing portion ms1 is an empty space.

The body missing portion ms1 is located on the upper side with respect to the face center Fc. The whole body missing portion ms1 is located on the upper side with respect to the face center Fc. The body missing portion ms1 is located on the upper side with respect to the center of gravity of the head 2. The whole body missing portion ms1 is located on the upper side with respect to the center of gravity of the head 2.

The body missing portion ms1 is disposed at the same toe-heel direction position as that of the face center Fc. In other words, the toe-heel direction position of the body missing portion ms1 includes the toe-heel direction position of the face center Fc. The heel joint portion Jh is located on the heel side with respect to the face center Fc. The toe joint portion Jt is located on the toe side with respect to the face center Fc.

In the state of the head 2 in which the body member bd1 and the face member fc1 are assembled, a top-side flange FL1 (to be described later) is disposed in the body missing portion ms1.

Figure 12:
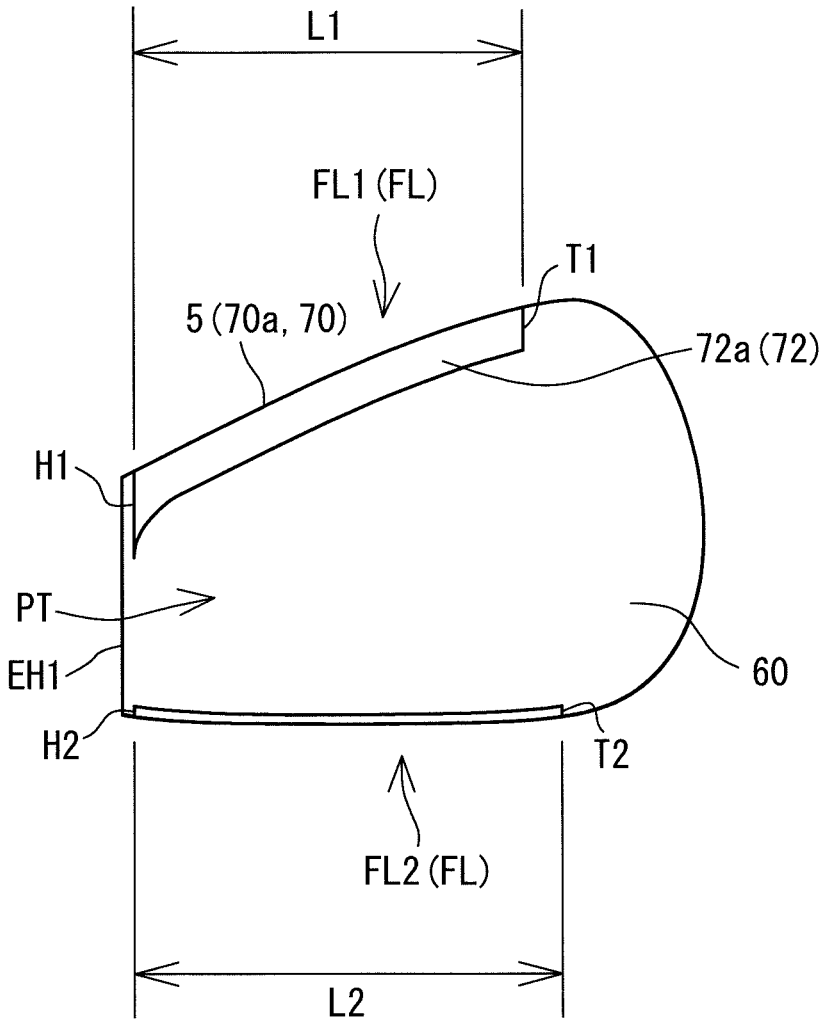
FIG. 12 is a back view of the face member in FIG. 11.
Figure 13:
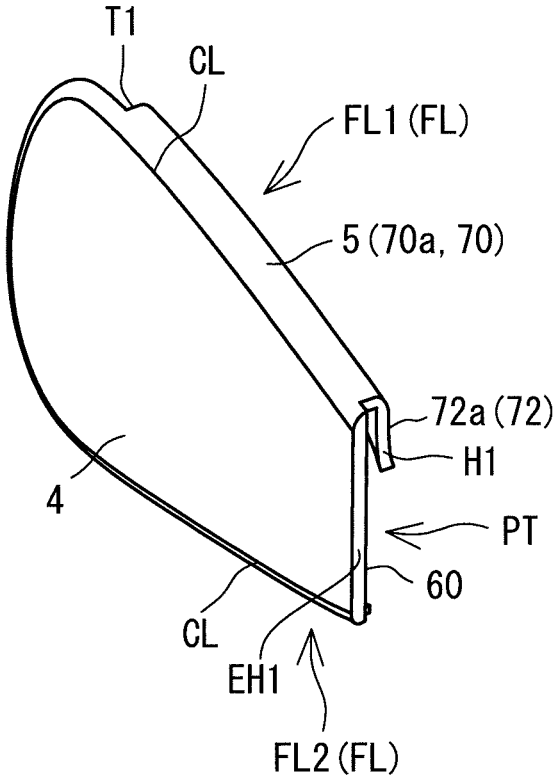
FIG. 13 is a perspective view of the face member in FIG. 11.
Figure 15:
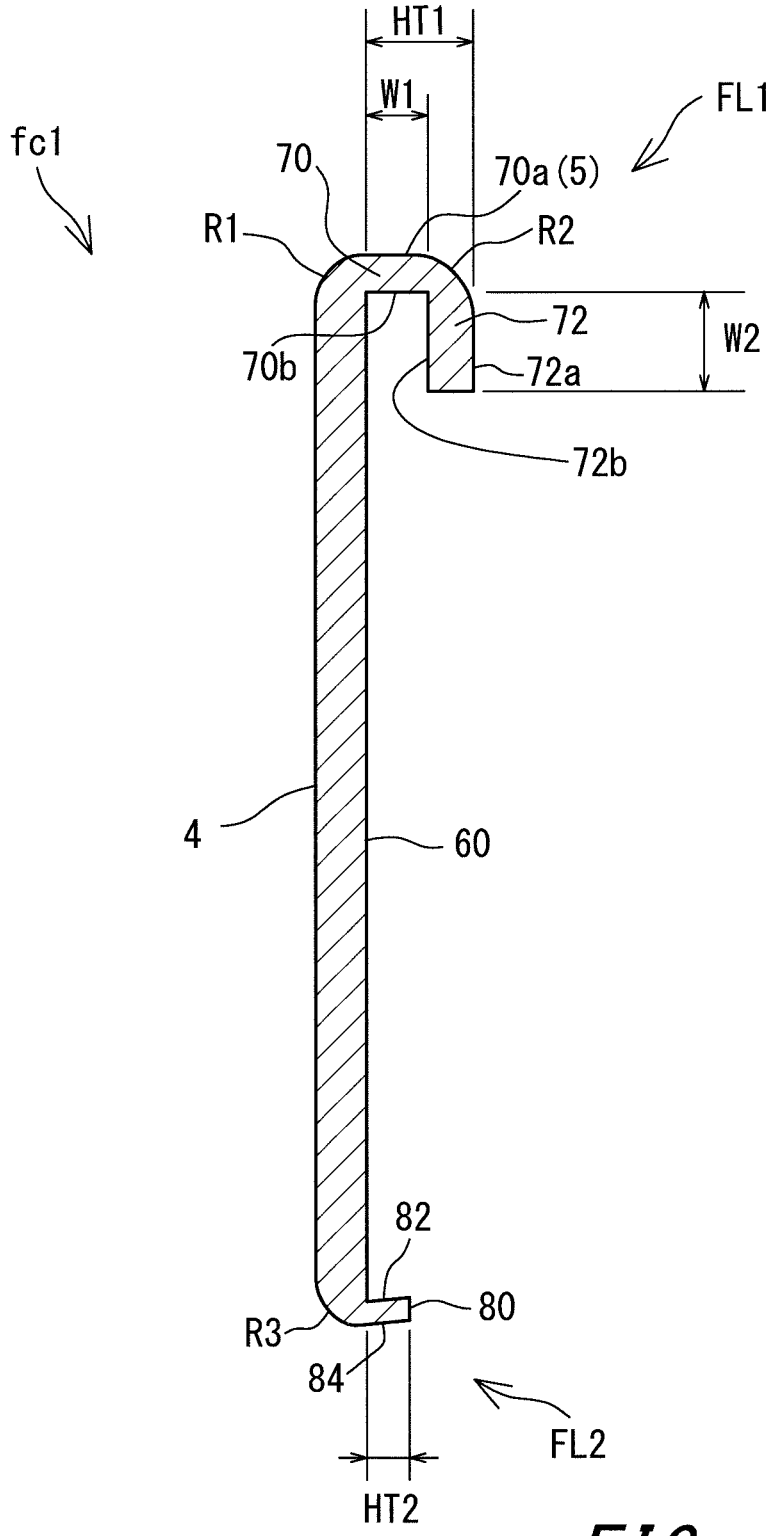
FIG. 15 is a sectional view taken along line A-A in FIG. 11.

FIG. 11 is a front view of the face member fc1. FIG. 12 is a back view of the face member fc1. FIG. 13 is a perspective view of the face member fc1 as viewed from an obliquely front side. FIG. 14 is a perspective view of the face member fc1 as viewed from an obliquely rear side. FIG. 15 is a sectional view taken along line A-A in FIG. 11. Furthermore, FIG. 6 and FIG. 7 described above show the face member fc1 as viewed from different angles.

The face member fc1 is formed by casting. Examples of the method of casting includes a sand casting process, gypsum casting process, precision casting process, mold casting process, a centrifugal casting process, etc. The method of casting is not limited. In light of forming accuracy, lost-wax precision casting process is preferably used.

As shown in FIG. 11, the above-mentioned plurality of score lines gv are provided on the front surface of the face member fc1. The front surface of the face member fc1 is the hitting surface 4.

As well shown in FIG. 14, the face member fc1 has the flat plate portion PT and a flange FL. The front surface of the flat plate portion PT is the hitting surface 4. The flat plate portion PT forms the hitting surface 4.

The flat plate portion PT has the back surface 60. The back surface 60 is a single plane. If the score lines gv are disregarded, the flat plate portion PT has a constant thickness. The back surface 60 is parallel to the hitting surface 4. The back surface of the face member fc1 is constituted by only the flange FL and the back surface 60. The flange FL is extended rearward from the peripheral edge of the flat plate portion PT. The flange FL is joined to the body member bd1.

Among the above-mentioned toe-side region, heel-side region, top-side region, and sole-side region, the flange FL is provided in the top-side region and the sole-side region. The flange FL may be provided in the top-side region only. The flange FL may be provided in the heel-side region. The flange FL may be provided in the toe-side region. A single flange FL may be provided over two or more regions.

The flange FL located in the top-side region is also referred to as a top-side flange. The flange FL located in the sole-side region is also referred to as a sole-side flange. The flange FL includes the top-side flange FL1 located in the top-side region, and the sole-side flange FL2 located in the sole-side region. In the present embodiment, the flange FL is constituted of only the top-side flange FL1 and the sole-side flange FL2. Any flange FL other than the top-side flange FL1 and the sole-side flange FL2 does not exist. The sole-side flange FL2 may not be present.

The top-side flange FL1 may be extended to another region other than the top-side region. For example, the top-side flange FL1 may be extended from the top-side region to the toe-side region. The sole-side flange FL2 may be extended to another region other than the sole-side region. For example, the sole-side flange FL2 may be extended from the sole-side region to the toe-side region.

The top-side flange FL1 includes at least a part of the top surface 5. The top-side flange FL1 may include the whole top surfaces 5.

The flange FL is not provided in the toe-side region. The flange FL is not provided in the heel-side region. In portions in which the flange FL is not provided, the back surface 60 reaches the outer edge of the face member fc1 (see FIG. 14).

As well shown in FIG. 15, the top-side flange FL1 has a rearward extending part 70 extended rearward, and a downward extending part 72 extended downward from a rear edge portion of the rearward extending part 70. The rearward extending part 70 has an upper surface 70*a* and a lower surface 70*b*. The upper surface 70*a* is the top surface 5. The downward extending part 72 has an outer surface 72*a* and an inner surface 72*b*. The outer surface 72*a* constitutes the back surface of the head 2. The outer surface 72*a* is parallel to the hitting surface 4. The inner surface 72*b* is parallel to the hitting surface 4.

The upper surface 70*a* of the rearward extending part 70 is continuous with the hitting surface 4. As shown in FIG. 15, a roundness R1 is provided on the boundary between the upper surface 70*a* and the hitting surface 4. The upper surface 70*a* is continuous with the outer surface 72*a* of the downward extending part 72. A roundness R2 is provided on the boundary between the upper surface 70*a* and the outer surface 72*a*.

A double-pointed arrow W1 in FIG. 15 shows a width of the lower surface 70*b* of the rearward extending part 70. The width W1 is measured along the front-rear direction. A double-pointed arrow W2 in FIG. 15 shows a width of the inner surface 72*b* of the downward extending part 72. The width W2 is measured along the up-down direction. In the present embodiment, the width W2 is greater than the width W1.

As described above, the face member fc1 is manufactured by casting. Casting can achieve a high productivity of the face member fc1 even when the face member fc1 includes the top-side flange FL1 having a complex shape. The roundness R1 improves molten metal flow in casting of the face member fc1, and can reduce defective rate in the casting. The roundness R2 improves molten metal flow in the casting of the face member fc1, and can reduce defective rate in the casting.

As well shown in FIG. 15, the sole-side flange FL2 is extended rearward. The sole-side flange FL2 has a rear-end surface 80, an upper surface (inner surface) 82, and a lower surface (outer surface) 84. The rear-end surface 80 is parallel to the hitting surface 4. The rear-end surface 80 is parallel to the back surface 60. The lower surface 84 is continuous with the hitting surface 4. A roundness R3 is provided on the boundary between the lower surface 84 and the hitting surface 4. The lower surface 84 constitutes a part of the sole surface 8.

The roundness R3 improves molten metal flow in the casting of the face member fc1, and can reduce defective rate in the casting.

As well shown in FIG. 14, the top-side flange FL1 has a toe-side end face T1 and a heel-side end face H1. The end face T1 includes a toe-side end face of the rearward extending part 70 and a toe-side end face of the downward extending part 72. The end face H1 includes a heel-side end face of the rearward extending part 70 and a heel-side end face of the downward extending part 72.

The toe-side end face T1 is located on the heel side with respect to the point RA (see FIG. 2). The heel-side end face H1 is located on the toe side with respect to the point RB (see FIG. 2). The toe-side end face T1 is located on the toe side with respect to a heel-side end face EH1 of the face member fc1. The heel-side end face EH1 of the face member fc1 is the heel-side end face of the flat plate portion PT. The end face EH1 is brought into contact with the heel boundary surface 22 (first heel boundary surface 22*a*) of the body member bd1 (see FIG. 7). The end face EH1 is welded to the heel boundary surface 22 (first heel boundary surface 22*a*).

The toe-side end face T1 of the top-side flange FL1 is brought into contact with the end face 42 of the toe-forming part 26 (see FIG. 6). The heel-side end face H1 of the top-side flange FL1 is brought into contact with the heel boundary surface 22 (second heel boundary surface 22*b*). The end face H1 is brought into contact with the upper end portion of the heel boundary surface 22 (second heel boundary surface 22*b*).

The toe-side end face T1 of the top-side flange FL1 is welded to the end face 42 of the toe-forming part 26. The heel-side end face H1 of the top-side flange FL1 is welded to the heel boundary surface 22 (second heel boundary surface 22*b*). The end face H1 is welded to the upper end portion of the heel boundary surface 22 (second heel boundary surface 22*b*).

As described above, the toe-side end face T1 of the top-side flange FL1 is joined to the end face 42 of the toe-forming part 26. In the present embodiment, the method of this joining is welding. The end face T1 is an example of the toe-side end of the top-side flange FL1. This end may not be an end face. The end face 42 is an example of the toe joint portion Jt joined to the toe-side end of the top-side flange FL1.

As described above, the heel-side end face H1 of the top-side flange FL1 is joined to the upper end portion of the second heel boundary surface 22*b*. In the present embodiment, the method of this joining is welding. The end face H1 is an example of the heel-side end of the top-side flange FL1. This end may not be an end face. The upper end portion of the second heel boundary surface 22*b* is an example of the heel joint portion Jh joined to the heel-side end of the top-side flange FL1.

As well shown in FIG. 12, the sole-side flange FL2 has a toe-side end face T2, and a heel-side end face H2. The toe-side end face T2 is located on the heel side with respect to the point RD (see FIG. 2). The heel-side end face H2 is located on the toe side with respect to the point RC. The heel-side end face H2 is located on the toe side with respect to the heel-side end face EH1 of the face member fc1.

The toe-side end face T2 of the sole-side flange FL2 is brought into contact with the sole-side end face 44 (see FIG. 6) of the toe wall part 38 of the body member bd1. The heel-side end face H2 of the sole-side flange FL2 is brought into contact with the heel boundary surface 22 (second heel boundary surface 22*b*).

The toe-side end face T2 of the sole-side flange FL2 is welded to the sole-side end face 44 of the toe wall part 38 of the body member bd1. The heel-side end face H2 of the sole-side flange FL2 is welded to the heel boundary surface 22 (second heel boundary surface 22*b*).

The top-side flange FL1 is disposed in the body missing portion ms1. The body member bd1 is not present behind the top-side flange FL1. The top-side flange FL1 constitutes atop blade of the head 2.

As shown in FIG. 9 and FIG. 10, the rear-end surface 80 of the sole-side flange FL2 is brought into contact with the sole receiving surface 50 of the sole-forming part 28. This contact is surface-contact. The rear-end surface 80 is welded to the sole receiving surface 50.

As shown in FIG. 8, FIG. 9 and FIG. 10, the head 2 has an undercut portion UC. In the present application, the undercut portion UC means a portion in which a gap in the front-rear direction between the flat plate portion PT1 and another part is present. The undercut portion UC expands a movable range of the flat plate portion PT. The undercut portion UC facilitates the deformation of the flat plate portion PT at impact. The undercut portion UC enhances rebound performance of the head 2.

As shown in FIG. 8, the undercut portion UC includes a top-side undercut UC1 located between the toe-forming part 26 and the flat plate portion PT. The top-side undercut UC1 enhances rebound performance in the top side of the hitting surface 4.

As shown in FIG. 8, FIG. 9 and FIG. 10, the undercut portion UC includes a sole-side undercut UC2 located between the sole-forming part 28 and the flat plate portion PT. The sole-side undercut UC2 enhances rebound performance in the sole side of the hitting surface 4.

As shown in FIG. 9 and FIG. 10, the undercut portion UC includes a top-side undercut UC3 located between the downward extending part 72 and the flat plate portion PT. The top-side undercut UC3 enhances rebound performance in the top side of the hitting surface 4.

As shown in FIG. 9 and FIG. 10, the upper surface 82 of the sole-side flange FL2 is not brought into contact with the body member bd1. In the present embodiment, the whole upper surface 82 is not brought into contact with body member bd1. The upper surface 82 faces a space (a space inside the sole-side undercut UC2). The lower surface 84 of the sole-side flange FL2 is not brought into contact with the body member bd1, either. The lower surface 84 faces a space (outside space). For this reason, restraint on the sole-side flange FL2 laid by the body member bd1 is suppressed. The sole-side flange FL2 is apt to be deformed. The sole-side flange FL2 facilitates deformation of the hitting surface 4 at impact. The sole-side flange FL2 contributes to improvement in rebound performance. Particularly, the sole-side flange FL2 enhances rebound performance in hitting at a lower hit point.

Except for portions brought into contact with the toe receiving surface 40 or the third heel boundary surface 22*c* (see FIG. 7), the flat plate portion PT of the face member fc1 is not supported from behind. The most portion of the flat plate portion PT (back surface 60) is not brought into contact with the body member bd1. This constitution facilitates deformation of the hitting surface 4 at impact.

[Effect of Body Missing Portion ms1]

It has turned out that rebound performance is enhanced by providing the body missing portion ms1 in the body member bd1 and disposing the flange FL in the body missing portion ms1 (rebound-performance enhancing effect). As a result of extensive studies, the inventor of the present application has found that the reasons why this effect can be obtained are as follows.

[Rebound-Performance Enhancing Effect A: Improvement in Rebound Performance Because of Eliminating Weld Bead]

In a conventional head, the whole circumference of the face member is welded to the body member. In the welding, weld bead is formed on the boundary between the face member and the body member. The weld bead is formed on the outer surface and the inner surface of the head because the welding is performed from the outer surface through the inner surface of the head in view of welding strength. The weld bead formed on the outer surface of the head can be eliminated by grinding, but the weld bead formed on the inner surface of the head is not be eliminated. When the weld bead is formed on the inner surface of the flange, the weld bead increases the thickness of the flange to suppress the deformation of the flange. As a result, bending of the face is suppressed, and rebound performance deteriorates. The welding between the flange FL and the body member bd1 can be avoided by providing the body missing portion ms1. For this reason, the weld bead is eliminated, thereby making it easier for the flange FL to be deformed. As a result, bending of the face is increased to improve rebound performance.

[Rebound-Performance Enhancing Effect B: Improvement in Rebound Performance by Reducing Rigidity of Body Member bd1]

In a conventional head, the body member forms a frame surrounding the whole periphery of a central opening of the body member. On the other hand, the body member bd1 of the present embodiment has a partially-missing structure in which a part of the frame is missing. By the partially-missing structure, the rigidity of the body member bd1 is reduced. As a result, the whole head 2 including the face member fc1 is easily bent, thereby improving rebound performance.

[Strength Maintaining Effect]

It has turned out that the strength of the head can be secured by only the flange FL even when there is no support from behind by the body member bd1 (strength maintaining effect). In has turned out that the strength of the blade portion can be maintained by the flange FL only. It is considered that this is brought by the effect of the physical shape of the flange FL. In addition, the head 2 as a whole is deformed by the above effect B thereby alleviating stress concentration. It is considered that this fact also contributes to the maintained strength.

The rebound performance enhancing effect A, the rebound performance enhancing effect B, and the strength maintaining effect are attained by the body missing portion ms1 and the top-side flange FL1. In the face member fc1, the sole-side flange FL2 may not be present.

In light of the strength maintaining effect, the top-side flange FL1 preferably has the rearward extending part 70 and the downward extending part 72. In light of the strength maintaining effect, the thickness of the top-side flange FL1 is preferably greater than the thickness of the sole-side flange FL2.

[Casting Deformation Suppressing Effect]

As described above, the face member fc1 is formed by casting. As compared with forging, casting makes the manufacture of the face member fc1 comparatively easy, even when the face member fc1 has a complex shape including the flange FL.

However, it has been found that when a face member having a flange extending continuously from the top-side region, through the toe-side region, to the sole-side region is produced, deformation by casting (casting deformation) of the face member becomes large. It also has been found that the deformation by casting reduces the degree of flatness of the face. The low degree of flatness necessitates further time and effort of subsequent treatment for enhancing the degree of flatness. In addition, the low degree of flatness increases defective rate.

On the other hand, it has turned out that deformation by casting is suppressed in the face member fc1 of the present embodiment. In the face member fc1, the degree of flatness of the hitting surface 4 after casting is high. In the present application, this effect is also referred to as a casting deformation suppressing effect.

The reason why the casting deformation suppressing effect is obtained is supposed as follows. In a face member having a plate shape, even when the face member is subjected to casting, casting deformation such as shrinkage is restrictive. As compared with this, in a face member having a flange, casting deformation such as shrinkage is large because of the presence of the flange. It is considered that the casting deformation occurs because the flange is provided only one side surface (back surface) of the plate and thus the face member is un-uniformly shrunk.

In the flange extending from the top-side region through the toe-side region to the sole-side region, the flange is long and is curved with a large curvature. When the curvature is large, difference between a peripheral length of the inside of the flange and a peripheral length of the outside of the flange becomes large. It is considered that when the curvature is large, the influence of the shrinkage of the flange is increased to make the casting deformation larger.

On the other hand, in the face member fc1 of the present embodiment, the flange FL is divided into two. That is, the flange FL is dividedly disposed in the top-side region and the sole-side region, and each of the flange FL1 and the flange FL2 is short. For this reason, the influence of the shrinkage of the flange FL is reduced and the casting deformation is suppressed.

Further, the contour line CL in the top-side region relatively resembles a straight line as compared with that of the toe-side region. Therefore, the top-side flange FL1 provided along the contour line CL in the top-side region is less curved (see FIG. 11). The casting deformation is suppressed by the less curved top-side flange FL1.

The same holds true for the sole-side flange FL2. The contour line CL in the sole-side region is relatively resembles a straight line as compared with that of the toe-side region (see FIG. 11). Therefore, the sole-side flange FL2 provided along the contour line CL in the sole-side region is less curved. The casting deformation is suppressed by the less curved sole-side flange FL2.

Symmetric property of the shape of the face member fc1 is enhanced by providing the sole-side flange FL2 in addition to the top-side flange FL1, and thus the deformation by casting is further suppressed. In light of suppressing the deformation by casting, the sole-side flange FL2 is preferably provided.

In addition, rebound performance is enhanced in a wide scope ranging from the top side to the sole side by the top-side flange FL1 and the sole-side flange FL2. Even when a hit point is close to the sole, a high rebound performance can be obtained. Even when a hit point is close to the top, a high rebound performance can be obtained.

A double-pointed arrow HT1 in FIG. 15 shows a height of the top-side flange FL1. The height HT1 is measured along the front-rear direction. The height HT1 is a height from the back surface 60. A double-pointed arrow HT2 in FIG. 15 shows a height of the sole-side flange FL2. The height HT2 is measured along the front-rear direction. The height HT2 is a height from the back surface 60.

As described above, the double-pointed arrow W1 in FIG. 15 shows the width of the lower surface 70*b* of the rearward extending part 70. The double-pointed arrow W2 shows the width of the inner surface 72*b* of the downward extending part 72.

In light of the strength maintaining effect, the height HT1 is preferably equal to or greater than 2 mm, more preferably equal to or greater than 3 mm, and still more preferably equal to or greater than 4 mm. In light of rebound performance, an excessively large rigidity of the top-side flange FL1 is not preferable. In light of rebound performance and the position of the center of gravity of the head, the height HT1 is preferably equal to or less than 10 mm, more preferably equal to or less than 9 mm, and still more preferably equal to or less than 8 mm.

In light of the strength maintaining effect, the width W1 is preferably equal to or greater than 1.5 mm, more preferably equal to or greater than 1.8 mm, and still more preferably equal to or greater than 2 mm. In light of rebound performance and the center of gravity of the head, the width W1 is preferably equal to or less than 6 mm, more preferably equal to or less than 5 mm, and still more preferably equal to or less than 4 mm.

In light of the strength maintaining effect, the width W2 is preferably equal to or greater than 1 mm, more preferably equal to or greater than 2 mm, and still more preferably equal to or greater than 3 mm. In light of rebound performance and the center of gravity of the head, the width W2 is preferably equal to or less than 10 mm, more preferably equal to or less than 9 mm, and still more preferably equal to or less than 8 mm.

A ball which is not teed up is often hit by an iron type golf club head. That is, a ball which is put directly on a lawn is often hit by the iron type golf club. For this reason, hitting by the iron type golf club often results in hitting at a lower hit point. In light of rebound performance in hitting at a lower hit point, the height HT2 is preferably equal to or greater than 2 mm, more preferably equal to or greater than 2.5 mm, and still more preferably equal to or greater than 3 mm. In light of strength, the height HT2 is preferably equal to or less than 7 mm, and more preferably equal to or less than 6 mm.

In light of the strength maintaining effect, the top-side flange FL1 has a thickness of preferably equal to or greater than 0.8 mm, more preferably equal to or greater than 1.0 mm, and still more preferably equal to or greater than 1.2 mm. In light of rebound performance and lowering the center of gravity of the head, the thickness of the top-side flange FL1 is preferably equal to or less than 2.5 mm, more preferably equal to or less than 2.2 mm, and still more preferably equal to or less than 2.0 mm.

In light of the strength, the sole-side flange FL2 has a thickness of preferably equal to or greater than 0.5 mm, more preferably equal to or greater than 0.6 mm, and still more preferably equal to or greater than 0.7 mm. In light of rebound performance, the thickness of the sole-side flange FL2 is preferably equal to or less than 2.0 mm, more preferably equal to or less than 1.9 mm, and still more preferably equal to or less than 1.8 mm.

In light of attaining both the strength maintaining effect and rebound performance, it is preferable that the top-side flange FL1 has a volume greater than that of the sole-side flange FL2. Note that in determination of the volume of the top-side flange FL1, a portion located in the rear with respect to a plane made by extending the back surface 60 is considered as the top-side flange FL1. Similarly, in determination of the volume of the sole-side flange FL2, a portion located in the rear with respect to a plane made by extending the back surface 60 is considered as the sole-side flange FL2.

A double-pointed arrow L1 in FIG. 12 shows a length of the top-side flange FL1. The length L1 is measured along the toe-heel direction. The length L1 is also a length of the body missing portion ms1. A double-pointed arrow L2 in FIG. 12 shows a length of the sole-side flange FL2. The length L2 is measured along the toe-heel direction. A double-pointed arrow L3 in FIG. 11 shows a length of the longest score line gv1. The length L3 is measured along the toe-heel direction.

In light of rebound performance, a ratio (L1/L3) is preferably equal to or greater than 0.7, more preferably equal to or greater than 0.8, and still more preferably equal to or greater than 0.9. In light of the strength maintaining effect, the ratio (L1/L3) is preferably equal to or less than 1.2, more preferably equal to or less than 1.15, and still more preferably equal to or less than 1.1.

In light of rebound performance, a ratio (L2/L3) is preferably equal to or greater than 0.7, more preferably equal to or greater than 0.8, and still more preferably equal to or greater than 0.9. In light of the dimension of the top-side region, the ratio (L2/L3) is preferably equal to or less than 1.2, more preferably equal to or less than 1.15, and still more preferably equal to or less than 1.1.

Figure 16:
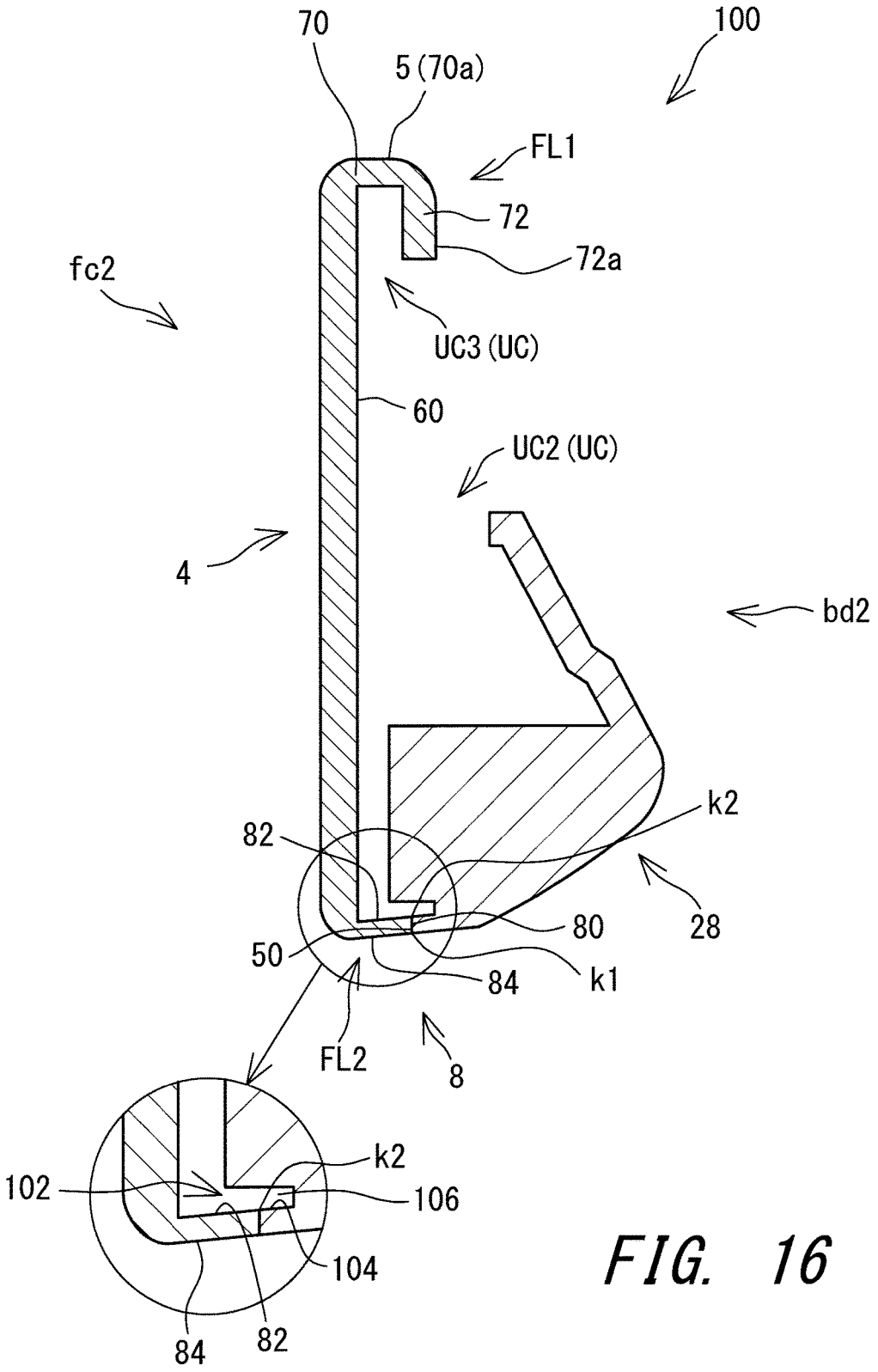
FIG. 16 is a sectional view of a golf club head according to a second embodiment.

FIG. 16 is a sectional view of a golf club head 100 according to a second embodiment. The head 100 includes a face member fc2 and a body member bd2. The head 100 has an outer boundary k1 which is a boundary between the face member fc2 and the body member bd2, and is located outside the head 100. The head 100 has an inner boundary k2 which is a boundary between the face member fc2 and the body member bd2, and is located inside the head 100. The body member bd2 has a recess part 102 which is adjacent to the inner boundary k2. Except for the presence of the recess part 102 and the height of the sole-side flange FL2, the head 100 is the same as the head 2.

The head 100 (body member bd2) has an inner boundary rearward surface 104 which is extended rearward from the inner boundary k2. The inner boundary k2 is a boundary between the upper surface (inner surface) 82 of the sole-side flange FL2 and the inner boundary rearward surface 104. The head 100 (body member bd2) has a rear space 106 which is adjacent to the inner boundary rearward surface 104. In the present embodiment, the inner boundary rearward surface 104 and the rear space 106 are formed by the recess part 102 provided on the sole receiving surface 50.

As described above, when the sole receiving surface 50 and the rear-end surface 80 are welded to each other, weld bead might accumulate in the vicinity of the inner boundary k2. If the bead accumulates inside the flange FL, the rigidity of the flange FL becomes high. If the rigidity of flange FL becomes high, rebound performance deteriorates.

A part of the bead flows to rearward of the inner boundary k2 by providing the inner boundary rearward surface 104. For this reason, the amount of the bead accumulating inside the flange FL decreases. As a result, the increase in the rigidity of the flange FL is suppressed and the deterioration of rebound performance is suppressed.

Figure 17:
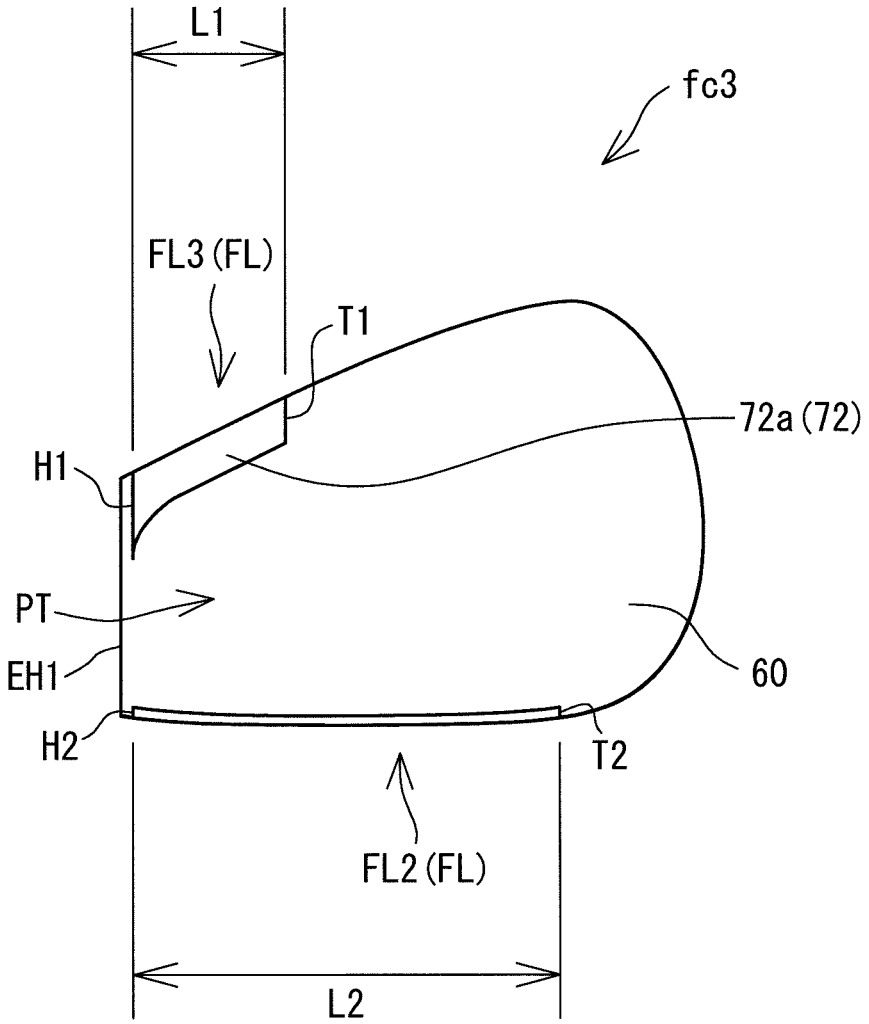
FIG. 17 is a back view of a face member according to a third embodiment.

FIG. 17 is a back view of a face member fc3 according to a third embodiment. Except that the length L1 of a top-side flange FL3 is shorter, the face member fc3 is the same as the face member fc1 according to the first embodiment. In the face member fc3, the top-side flange FL3 is disposed on the heel side with respect to the face center Fc.

Figure 18:
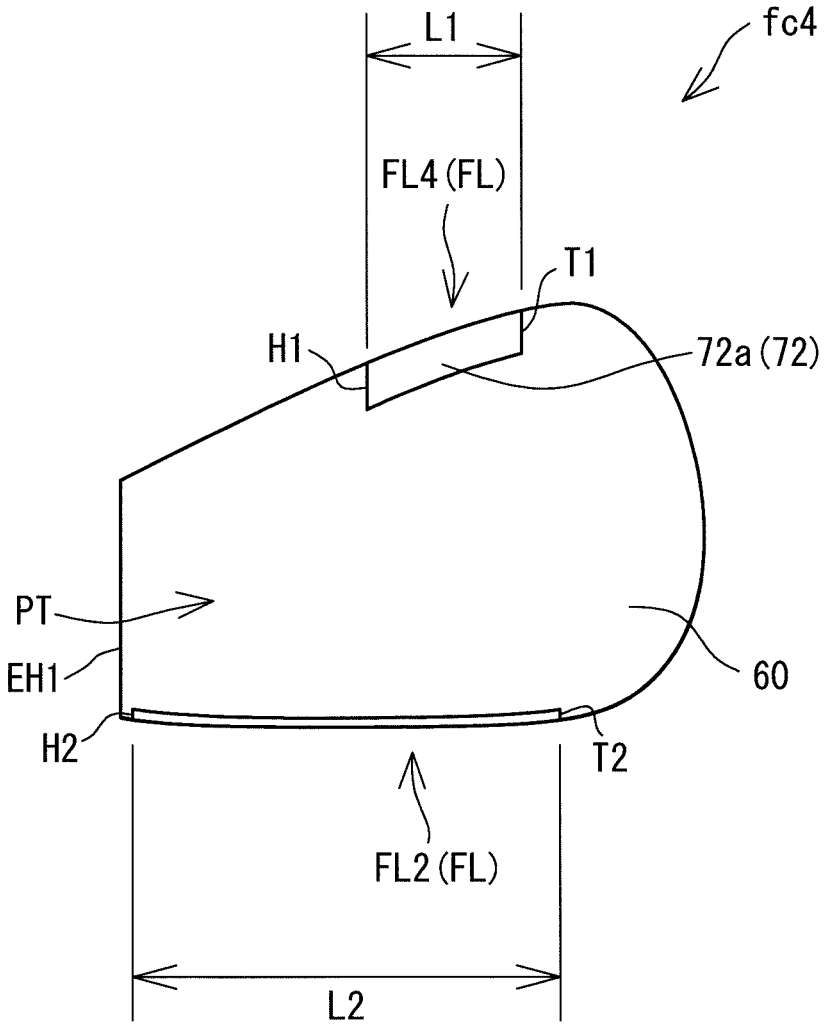
FIG. 18 is a back view of a face member according to a fourth embodiment.

FIG. 18 is a back view of a face member fc4 according to a fourth embodiment. Except that the length L1 of a top-side flange FL4 is shorter, the face member fc4 is the same as the face member fc1 according to the first embodiment. In the face member fc4, the top-side flange FL4 is disposed on the toe side with respect to the face center Fc.

Figure 19:
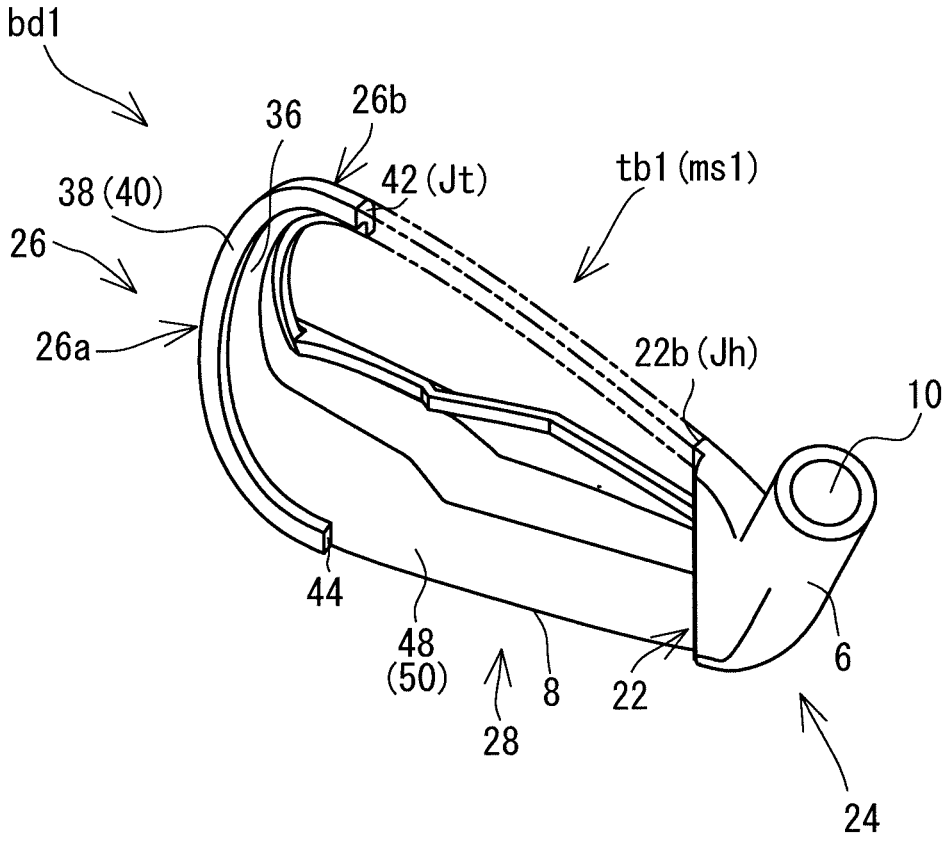
FIG. 19 is a perspective view of a body member for illustrating the degree of freedom of position of a body missing portion.

FIG. 19 is a perspective view of the body member bd1 according to the first embodiment. In this FIG. 19, a top-blade forming part tb1 connecting the toe joint portion Jt and the heel joint portion Jh is shown by a virtual line (two-dot chain line).

In the above-described first embodiment, a part of the top-blade forming part tb1 is missing. The missing portion is the body missing portion ms1. The missing portion is bridged by the face member fc1. The missing portion is bridged by the top-side flange FL1.

The positions of the toe joint portion Jt and the heel joint portion Jh can be changed by changing the length and position of the top-blade forming part tb1. The length and position of the body missing portion ms1 can be changed by changing the length and the position of the top-blade forming part tb1.

In the third embodiment, the body missing portion ms1 is provided at a position corresponding to the top-side flange FL3 of the face member fc3 (FIG. 17). In this case, the top-blade forming part tb1 is formed between the toe-side end face T1 of the top-side flange FL3 and the end face 42 of the toe-forming part 26. An end face of the top-blade forming part tb1 is the toe joint portion Jt. In the third embodiment, the toe-side end face T1 of the top-side flange FL3 is located on the heel side with respect to the face center Fc.

In the third embodiment, the body missing portion ms1 is provided at a position close to the heel side. Therefore, rebound performance of the heel side of the face is enhanced.

In the fourth embodiment, the body missing portion ms1 is provided at a position corresponding to the top-side flange FL4 of the face member fc4 (FIG. 18). In this case, the top-blade forming member tb1 is formed between the heel-side end face H1 of the top-side flange FL4 and the upper end portion of the heel boundary surface 22. An end face of the top-blade forming part tb1 is the heel joint portion Jh. In the fourth embodiment, the heel-side end face H1 of the top-side flange FL4 is located on the toe side with respect to the face center Fc.

In the fourth embodiment, the body missing portion ms1 is provided at a position close to the toe side. Therefore, rebound performance of the toe side of the face is enhanced.

Thus, an area having a high rebound performance can be adjusted by changing the position of the body missing portion ms1.

The face member fc1 is preferably made of a metal, and more preferably made of a metal which can be subjected to casting. Examples of the metal include pure titanium, a titanium alloy, stainless steel, maraging steel, an aluminum alloy, a magnesium alloy, and a tungsten-nickel alloy. In light of easiness of casting and strength, a titanium alloy and stainless steel are preferable, and stainless steel is more preferable.

In light of weldability with the face member fc1, a material of the body member bd1 is preferably the same kind of material as that of the face member fc1, and is more preferably the same material as that of the face member fc1. Note that the same kind of material means a material having a same principal component. The principal component means a component having a weight ratio of 50% or more.

As explained above, in the present embodiments, the body missing portion ms1 is provided to reduce welded area between the flange FL and the body member bd1, and thus an accumulation of weld bead on the flange FL is prevented. For this reason, the flange FL becomes easier to deform, and rebound performance can be enhanced.

The present disclosure can be preferably applied to an iron type head.

The above description is merely illustrative example, and various modifications can be made.

What is claimed is:

1. A golf club head comprising: a top surface; a hitting surface; a sole surface; a toe-side surface; and a hosel, wherein the golf club head includes: a face member having the hitting surface which includes a face center; and a body member having the hosel, the sole surface, and the toe-side surface, the face member further includes a top-side flange including the top surface, the body member includes a hosel-forming part including the hosel, a sole-forming part including the sole surface, a toe-forming part including the toe-side surface, a central opening and a body gap structure in which a part of a frame surrounding the central opening periphery is absent, the hosel-forming part includes a heel joint portion joined to a heel-side end of the top-side flange, the toe-forming part includes a toe joint portion joined to a toe-side end of the top-side flange, a body gap portion in which the body member is absent is provided between the toe joint portion and the heel joint portion, and the top-side flange occupies the body gap portion so as to make the frame continuous.

2. The golf club head according to claim 1, wherein the body gap portion is disposed at a position in a toe-heel direction which is the same as that of the face center.

3. The golf club head according to claim 1, wherein the body gap portion is disposed at a toe side with respect to the face center.

4. The golf club head according to claim 1, wherein the body gap portion is disposed at a heel side with respect to the face center.

5. The golf club head according to claim 1, wherein the face member further comprises sole-side flange including the sole surface.

6. The golf club head according to claim 1, wherein the body gap portion occupied by the top-side flange includes an upper blade forming portion.

7. The golf club head according to claim 1, wherein the body member is not present rearward of the top-side flange.

8. The golf club head according to claim 1, wherein the top-side flange has a rearward extending part that extends rearward, and a downward extending part that extends downward from a rear edge portion of the rearward extending part.

9. The golf club head according to claim 8, wherein an upper surface of the rearward extending part constitutes the top surface.

10. The golf club head according to claim 8, wherein an outer surface of the downward extending part constitutes a back surface of the head.

11. A golf club head comprising: a top surface; a hitting surface; a sole surface; a toe-side surface; and a hosel, wherein the golf club head includes: a face member having the hitting surface; and a body member having the hosel, the sole surface, and the toe-side surface, the face member further includes a top-side flange including the top surface, the body member includes a hosel-forming part including the hosel, a sole-forming part including the sole surface, and a toe-forming part including the toe-side surface, the hosel-forming part includes a heel joint portion joined to a heel-side end of the top-side flange, the toe-forming part includes a toe joint portion joined to a toe-side end of the top-side flange, a body gap portion in which the body member is absent is provided between the toe joint portion and the heel joint portion, and the top-side flange has a height HT1 of equal to or greater than 2 mm and equal to or less than 10 mm.

12. A golf club head comprising: a top surface; a hitting surface; a sole surface; a toe-side surface; and a hosel, wherein the golf club head includes: a face member having the hitting surface; and a body member having the hosel, the sole surface, and the toe-side surface, the face member further includes a top-side flange including the top surface, the body member includes a hosel-forming part including the hosel, a sole-forming part including the sole surface, and a toe-forming part including the toe-side surface, the hosel-forming part includes a heel joint portion joined to a heel-side end of the top-side flange, the toe-forming part includes a toe joint portion joined to a toe-side end of the top-side flange, a body gap portion in which the body member is absent is provided between the toe joint portion and the heel joint portion, and the top-side flange has a thickness of equal to or greater than 0.8 mm and equal to or less than 2.5 mm.

* * * * *